United States Patent [19]

Henkel

[11] Patent Number: 4,711,209

[45] Date of Patent: Dec. 8, 1987

[54] FUEL INJECTION SYSTEM FOR SELF-IGNITION INTERNAL COMBUSTION ENGINES

[75] Inventor: Dietmar Henkel, Neumarkt, Fed. Rep. of Germany

[73] Assignee: MAN Nutzfahrzeuge GmbH, Nuremberg, Fed. Rep. of Germany

[21] Appl. No.: 861,056

[22] Filed: May 8, 1986

[30] Foreign Application Priority Data

May 8, 1985 [DE] Fed. Rep. of Germany ..... 3516537

[51] Int. Cl.[4] ..... F02M 39/00

[52] U.S. Cl. ..... 123/300; 123/501; 123/467

[58] Field of Search ..... 123/300, 299, 500, 501, 123/506, 467, 446

[56] References Cited

U.S. PATENT DOCUMENTS

| | | | |
|---|---|---|---|
| 2,173,813 | 9/1939 | Bischof | 123/300 |
| 4,520,774 | 6/1985 | Sitter | 123/300 |
| 4,590,903 | 5/1986 | Hoffmann | 123/300 |
| 4,590,904 | 5/1986 | Wannenwetsch | 123/300 |
| 4,612,905 | 9/1986 | Dietrich | 123/300 |

FOREIGN PATENT DOCUMENTS

| | | | |
|---|---|---|---|
| 210264 | 6/1940 | Switzerland | 123/300 |

*Primary Examiner*—Carl Stuart Miller

*Attorney, Agent, or Firm*—Becker & Becker, Inc.

[57] ABSTRACT

A fuel injection system for self-ignition internal combustion engines. At least part of the connecting line leading from the injection pump to the injection valve includes two circuits of different lengths which are connected in parallel in order to obtain a pre-injection phase and a main injection phase. In order to accurately set the fuel quantity for pre-injection, and the time interval relative to main injection or, respectively, the timing of the two fuel injections, and to make them independent of the level and the time characteristic of the pump pressure, i.e., ultimately independent of the speed and load of the engine, a special metering valve unit is provided in the shorter circuit of the divided connecting circuit, and a check valve unit is provided in the longer circuit at the end of the latter. Furthermore, the ratio of the diameter of the fuel line leading to the injection device, including the shorter circuit, to the diameter of the longer circuit (time-delay circuit) is between 1 and 2.

11 Claims, 3 Drawing Figures

FUEL INJECTION SYSTEM FOR SELF-IGNITION INTERNAL COMBUSTION ENGINES

BACKGROUND OF THE INVENTION

1. Field of the Invention

The present invention relates to a fuel injection system for self-ignition internal combustion engines, and includes an injection pump that delivers metered fuel quantities, at periodic intervals, via a connecting line to an injection valve. At least part of the connecting line comprises two different-length circuits which are connected in parallel and which cause the fuel quantity supplied via a feed line to be divided in such a manner that, on the one hand, a small fuel quantity (pre-injection quantity) passes through the shorter circuit and, on the other hand, a larger fuel quantity (main injection quantity) passes through the longer circuit (time-delay circuit), with the two fuel quantities reaching the injection valve with a time lag relative to one another.

2. Description of the Prior Art

Improving fuel consumption is one of the most pressing objectives of development, even in the case of the Diesel engine, which is inherently economical. Faster injection as well as finer and larger-volume atomization of the fuel are usual means of achieving the shortening of the combustion period desired in this connection in order to increase the efficiency of the Diesel cycle in this manner.

The well-known disadvantage of these measures is the high rate of increase of the combustion chamber pressure subsequent to ignition. This is accompanied by the excitation, by higher energy gas forces, of natural modes of the engine structure, which explains the undesirably high air-borne noise emission of such engines optimized for fuel economy. In the face of anticipated further tighter legislation with respect to noise control in internal combustion engines, the designer is confronted with the task of finding means and measures to lower the rate of pressure rise in the combustion chamber—which is a function of the processes taking place during ignition of the mixture—without adversely affecting fuel economy.

A promising concept in this connection has proved to be pre-injection. This involves subdividing fuel injection into two separate timed phases. The first phase provides for a small amount of fuel to be injected, and is followed at a defined time interval by a larger fuel volume (main injection) in the second phase.

In this concept, it is important that it should be possible to make defined settings of both the amount of pre-injected fuel and the time interval between pre-injection and main injection. A high degree of reproducibility of both parameters, which includes their independence of operational state parameters of the engine, such as torque and speed, but also injection line pressure, is another requirement which the modified injection system should satisfy.

The size of the fuel volume for pre-injection is important in as much as it determines the amount of radicals released during the so-called cold-flame and blue-flame pre-reaction phase (of the pre-injected fuel). The latter is decisive for the degree to which the ignition lag which characterizes the main injection is shortened. Since a short ignition lag (which is a prerequisite for lowering the rate of pressure rise in the combustion chamber) is the objective, it is therefore necessary to provide a minimum metered feed of pre-injection fuel to enable sufficient free radicals to be available to bring about the above-mentioned desirable reduction in ignition lag.

The defined setting of a constant time interval between pre-injection and main injection as stipulated above also serves to maximize the amount of radicals that are available. This is because the longer the cold-flame and blue-flame pre-reaction triggered by pre-injection is left alone (e.g. until briefly before the commencement of the hot explosion flame), the greater the enrichment of the fuel-air mixture with radicals.

A pre-condition for optimizing the time interval to be set between pre-injection and main injection is that the engine-specific ignition lag should be only slightly dependent on the operationally dictated load and speed variations of the engine.

Apart from cold starting or the transition from an extended low-load phase to full load (turbocharged engine!), such stability can be assumed in a first approximation to exist at least in an engine at operating temperature.

In a fuel injection system of the initially mentioned type (see Swiss Pat. No. 210 264, of Gebrüder Sulzer, Aktiengesellschaft, dated during 1940), the pressure wave that passes through a short and moreover narrow-bore injection line to the injection valve causes the injection valve to open and, consequently, to effect pre-injection before the pressure wave propagating through a long and moreover wide-bore line reaches the injection valve. By means of an adjustable throttling valve (restrictor screw), the amount of fuel flowing through the short line is adjusted, for instance as a function of an operational parameter (load or speed).

This prior-art system suffers from a number of disadvantages. On the one hand, as a result of the narrow short line, the pressure at the outlet of the injection pump, which is a function of the load and speed of the engine, determines the amount of fuel for pre-injection and its time pattern. On the other hand, there is the risk in the partial-load range that the pressure surge transmitted through the short line to the injector is insufficient to open the nozzle needle. In this case, which is especially important with respect to noise, it is then necessary to shut off the short line, so that operation has to be continued without pre-injection and with the disadvantage of the hydraulic accumulator effect in the long line (which causes injection to be delayed during the build-up of the pressure in the injection line until eventually the injection valve opens). Moreover, there is no uncoupling of the pre-injection pressure wave relative to the injector end of the longer main injection line. This tends to result in undesirable pronounced variations of the line pressures in time and interference with the process of fuel injection into the combustion chamber (especially at partial load). The latter causes losses in the volume of pre-injected fuel because a pressure-reducing effect originates from the injector end of the large-bore main injection line.

It is therefore an object of the present invention, in a fuel injection system of the aforementioned general type, to provide accurate setting of the amount of fuel for pre-injection and the time interval relative to the main injection or, respectively, the points of commencement of the two fuel injections, and to make the operation practically independent of the level and variation in time of the pump pressure, i.e. ultimately independent of the speed and load of the engine.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figures 1, 3:
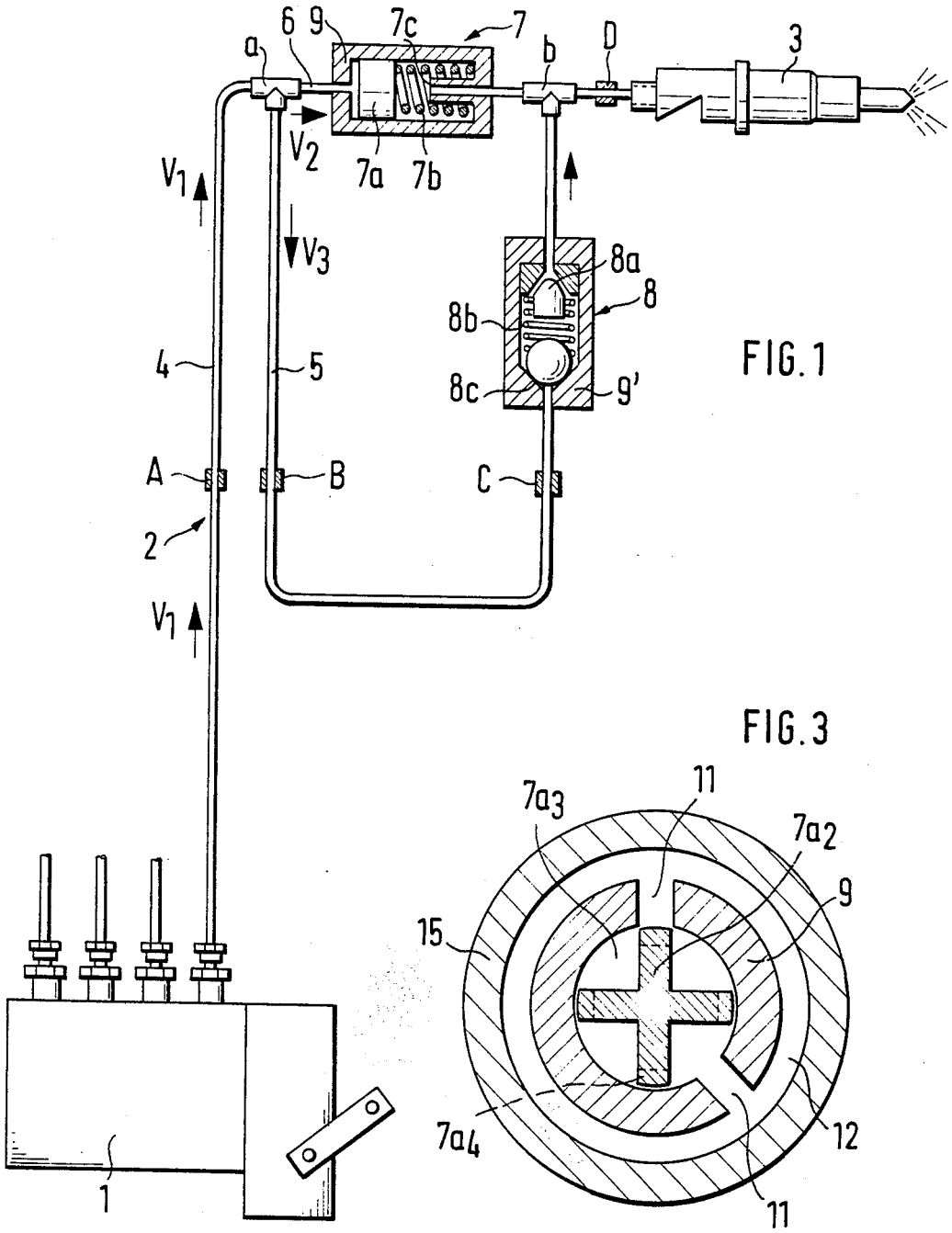
FIG. 1 schematically illustrates one exemplary embodiment of the fuel injection system of the present invention.
FIG. 3 is a section taken in the area of the line III—III in FIG. 2, however, as provided with a different arrangement of the radial ports in the piston housing of the metering valve unit.

The fuel injection system of the present invention is characterized primarily in that the shorter circuit of the subdivided connecting line is provided with a metering valve unit, and the longer circuit is provided with a check valve unit, at its end; the ratio of the diameter $d_s$ of the feed line, including the shorter circuit, to the diameter $d_v$ of the time-delay circuit is between 1 and 2.

As a result of the features described, the stated object is fully realized. On the one hand, the special metering valve unit (volumetric metering is effected by means of a stop-controlled plunger piston) permits an amount of fuel for pre-injection to be metered which remains constant at all times. On the other hand, the provision of the check valve unit ensures satisfactory hydraulic uncoupling of the two fuel injections (pre-injection and main injection) which are effected at the same time intervals at all times. Essentially, the check valve prevents the pressure and volume waves of the pre-injection from entering the outlet end of the main injection line. As a result, there are no volume losses of the pre-injection amount (and metering inaccuracies which these are liable to produce), nor are there any multiple reflections of pressure waves which alternately enter into either line, and the resultant interference with pre-injection and main injection. Since there is no throttling in the short line (on the contrary, the ratio between the feed line and the time-delay line should be between 1 and 2), the pre-injection amount or, respectively, the point of commencement of pre-injection, is practically independent of the level and the time pattern of the pump pressure, i.e. is practically independent of the speed and load of the engine. Nor can any volume losses of the pre-injection amount or, respectively, a different length of the pre-injection period, arise.

A further development of the invention provides for the line section through which the pre-injection fuel quantity passes to have only a short length and to be arranged in the immediate vicinity of the injection valve, and could even be disposed in the nozzle holder for the latter. Such a pre-injection line has only a very small volume storge capacity. One the one hand, this arrangement prevents the risk of undesired pressure wave reflections during the pre-injection phase while, on the other hand, the requirement for fast injection of the pre-injection quantity is obtained, i.e. pre-injection has long subsided before main injection starts. This provides another ccontribution towards uncoupling of the two injection phases which otherwise would mutually interfere with each other in an undesirable manner.

Further advantageous developments of the invention will be described in detail subsequently. In particular, mention will be made of combining the metering and check-valve unit into one physical unit where, in order to minimize complexity, only a single preloading spring is used.

DESCRIPTION OF PREFERRED EMBODIMENTS

Referring now to the drawings in detail, FIG. 1 illustrates a fuel injection system for an internal combustion engine with injection of liquid fuel and compression ignition using a conventional fuel injection pump 1 which feeds fuel in metered quantities via a connecting line 2 to at least one fuel injection valve 3. The fuel volume $V_1$ displaced by the pump element passes through the supply line 4 (feed line) to a 3-way interface or branching point "a" where it branches into two partial flows $V_2$ and $V_3$. The circuits 5 and 6 of the connecting line 2 have different lengths. The short circuit 6 is provided with a metering valve unit 7 that effects pre-injection of the fuel, and the long circuit 5 (time-delay circuit) is provided with a check valve unit 8 that ensures the main injection of the fuel. Ahead of the inlet of the injection valve 3, the two circuits 5, 6 are reunited at the 3-way interface or branching point "b". The so-called time-delay circuit 5 provides the phase lag between pre-injection and main injection, and the check valve 8 serves to hydraulically uncouple pre-injection and main injection.

Figure 2:
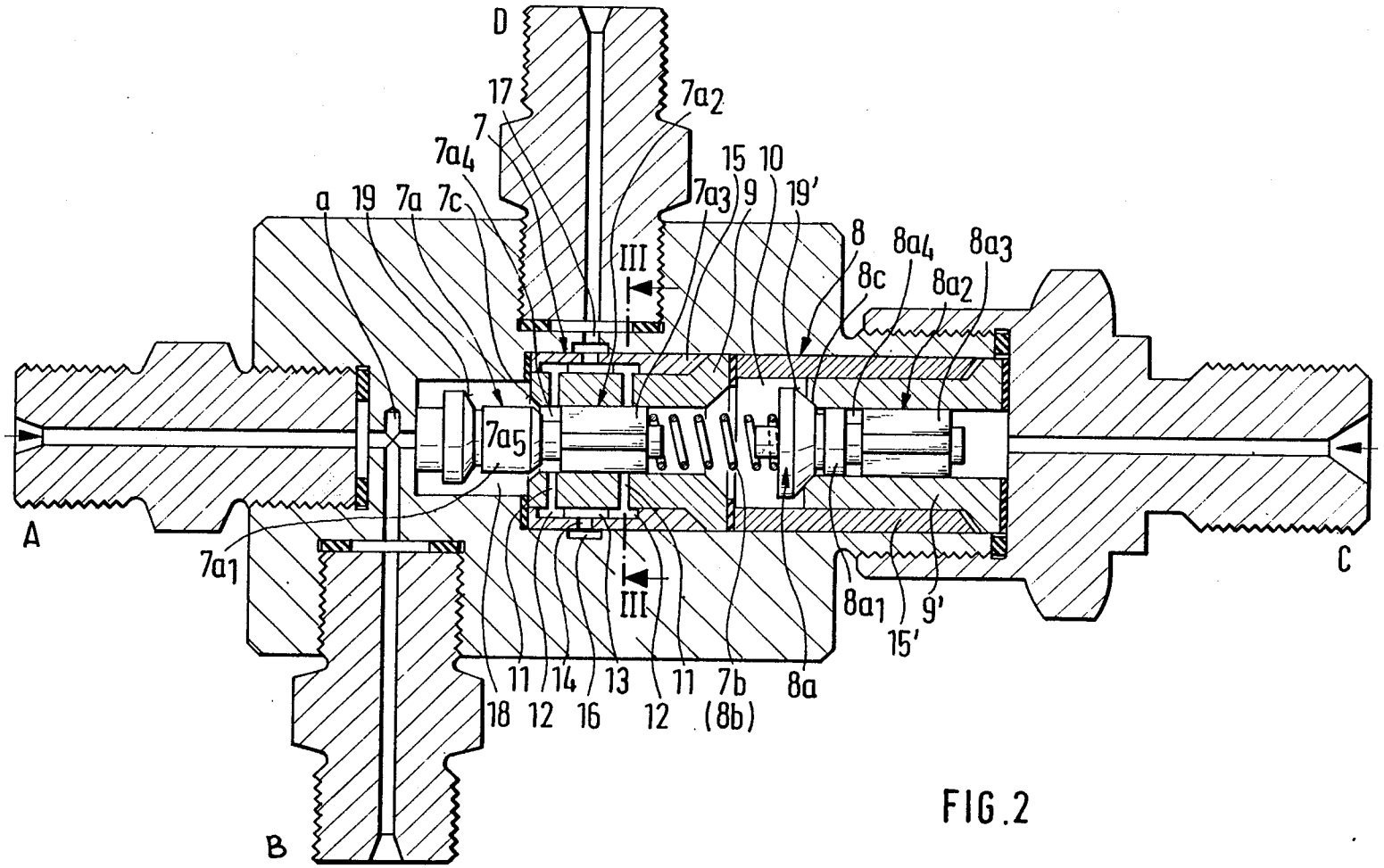
FIG. 2 is a longitudinal section through a specific embodiment of the invention combined into a single physical unit.

The points marked with the letters A, B, C and D in the circuits are intended to represent the connections of the specific embodiment illustrated in FIG. 2, where the system according to the invention is combined into one unit.

The interaction of the components of the system, in particular the metering valve unit 7, the time-delay circuit 5, and the check valve 8, are proposed to be broadly explained on the basis of the time pattern of an injection cycle. A detailed explanation will be given in the description of FIG. 2.

The volume flow $V_2$ (volume flow in circuit 6) moves the metering piston *7a* of the metering valve unit 7, which piston in its normal or rest position contacts the left-hand end of the piston housing 9, against the preloading force of the spring *7b* and the opening pressure of the needle of the injection valve 3, up to the sealing contact face *7c*, whereby the displaced fuel volume, which is determined by the diameter of the piston *7a* and the distance travelled by the piston, and which passes through a very short circuit length, is delivered as the pre-injection quantity via the injector, i.e. the injection valve 3, into the combustion chamber of the internal combustion engine. A pre-condition for successful pre-injection (accurate metered volume and slight hydraulic lag of pre-injection) is firstly the satisfactory venting or bleeding of the fuel volume that surrounds the metering piston *7a* (what is meant is the fuel volume in the space 18; see FIG. 2) and, secondly, obviously also venting of the fuel volume existing between the end face—contiguous to the 3-way interface "b"—of the piston *7a*, and the needle seat of the injection valve 3 and valve seat *8c* respectively of the check valve 8. The measures to be taken to ensure the vented condition referred to are described in FIG. 2. To prevent back-feeding into the time-delay circuit 5, which would be liable to occur at the 3-way interface "b", the check valve 8 referred to earlier is provided at the end of this circuit.

Simultaneously with the volume flow $V_2$, the volume flow $V_3$ passes through the time-delay circuit 5 with a sound velocity (c=1400 m/sec) in the direction towards the 3-way interface "b". The length of the time-delay circuit 5 is selected in such a way that the pre-injection phase is already completed before the volume $V_3$ opens the check valve 8 and, as a result, initiates main injection by renewed lifting off of the nozzle needle of the injection valve 3.

At the moment the pressure wave arrives (originating from the time-delay circuit 5), the metering piston *7a*, which is still in the end stop position as a result of the pre-injection phase, experiences a slight acceleration by the small force of the pre-loading spring *7b*. This can be explained by the collapse of the differential pressure that acts on the metering piston *7a*. Prior to the arrival of the pressure wave from the time-delay circuit 5, this differential pressure has a value corresponding to the difference between the line pressure at the 3-way interface "a" and the low line pressure at the 3-way interface "b". When the delayed pressure wave arrives, this value instantly decreases to substantially zero. Consequently, the only remaining force acting on the metering piston (roughly for the period of the main injection) is the force of the pre-loading spring *7b*, which produces only a slight return speed of the piston. When, however, towards the end of the main injection, the line pressure at the 3-way interface "a" drops, which is followed with a corresponding lag by an equal decreases at the 3-way interface "b", a differential pressure arises which imparts a high acceleration to the piston *7a* in the direction towards the initial position for a brief period. This ensures, on the one hand, that the return motion of the metering piston *7a* during the main injection does not withdraw any appreciable volume portions from the latter and that, on the other hand, the necessary initial position of the piston *7a* is always reached before the start of the next pre-injection.

Referring to FIG. 2, essential parts of the fuel injection system according to the invention (metering valve unit 7 and check valve unit 8) are combined into a single physical unit. The reference numerals and letters introduced in FIG. 1 also apply to this figure. For a better understanding of the subject matter of the invention, the phases of an injection cycle are described again, and the intention of design criteria for individual components is explained in greater detail.

FIG. 2 shows the initial condition, i.e. the stationary condition.

The fuel quantity metered by the injection pump is delivered via a connection union or connector A to the (divided-injection) unit. After passing the connection union A, the fuel volume is divided at the 3-way interface "a" into the two part flows $V_2$ and $V_3$ in accordance with FIG. 1.

The pressure of the fuel causes the piston *7a* to move from the end stop at the 3-way interface "a" into a cylinder member 9 and, simultaneously, compresses the spring *7b*. As a result, the check valve piston *8a*, which is loaded by the same spring *7b* (*8b*), is pressed with a greater force against its seat *8c*. The movement of the piston *7a* causes the fuel to be displaced from the pressure space 10 (which is identical with the 3-way interface "b" in FIG. 1). This displacement is achieved by a specially shaped piston shank $7a_2$ which has a cross-shaped cross-section (see FIG. 3). This shape is realized by four recesses $7a_3$ which are parallel to the shank axis, and which have a quadrant-shaped cross-section. In addition, the beams of the cross are slightly turned down (cutouts $7a_4$) in the front region of the piston shank (in the direction towards the central piston part $7a_1$ or, respectively, the 3-way interface "a").

Further delivery of the fuel then occurs via radial ports 11 in the piston housing 9. The figure shows two ports on each side which are offset by 180°. However, there may be more than a total of four radial ports. It is expecially advantageous if these ports 11 have a different circumferential offset than 180° (for instance 180° plus 45° or 90° plus 45°). This ensures that there are always at least two ports open, even if the piston *7a* happens to be turned. The radial ports 11 open into peripheral grooves 12 that are provided on the (outer) circumference of the piston housing 9. From there, the fuel is delivered via axial connecting grooves 13, which are also provided on the circumference of the piston housing 9, into radial ports 14 that are provided in an adapter piece or liner 15. These ports communicate with a circumferential groove 16 in the basic part of the (divided-injection) unit. This groove leads via a radial port 17 to another connection union or connector D. This connection union D communicates with the feed-line in the injection valve 3. For the purpose of satisfactory venting of the space 18, the piston *7a* (more specifically the central part $7a_1$ of the piston *7a*) is chamfered at the transition to the piston shank $7a_2$ at least at one point (chamfer $7a_5$). In the illustrated embodiment, two chamfers are provided which are opposite one another.

The movement of the piston *7a* comes to an end when the face 19 contacts the sealing face *7c* of the shutoff valve. At the same time, this completes the metering function for the pre-injection fuel quantity.

The basic part of the (divided-injection) unit is furthermore provided with a connection union B and a connection union C so that, as shown in FIG. 1, the fuel volume $V_3$ can flow via a time-delay circuit 5 to the check valve unit 8 (see also discussion of FIG. 1).

All connection unions (A,B,C,D) are screwed into the basic part and are fitted with suitable gaskets. The connection union C locates and holds in position the inserted parts of the metering valve 7 as well as of the check valve unit 8 (also via suitable gasket). The check valve unit 8 is constructed analogously to the metering valve 7. The corresponding reference numerals for the individual parts are $8a_1$, $8a_2$, $8a_3$, $8a_4$, 9', 15' and 19'.

The following explanations should be noted: in the initial position, the drilled line that comes from the 3-way interface "a" and enters the space 18 is completely covered by the end face of the metering piston *7a*, assisted by the force of the spring *7b* (*8b*). This ensures that the pressure wave arriving from the feed line (supply line in FIG. 1) is "solidly" reflected, in terms of wave mechanics, for a brief period (only as long as the metering piston *7a* covers the port). The pressure increase which briefly results from this in the region of the 3-way interface "a" on the one hand causes very fast opening of the metering valve 7 and, on the other hand, ensures a desirably high pressure of the pressure wave entering the time-delay circuit 5.

In conformity to the total length ($L_v$) of the time-delay circuit 5, the second pressure wave front within the time-delay circuit 5, starting from the 3-way interface "a" and ending in the check valve 8 (obviously this also includes the circuit sections of the connections B and C and the circuit sections in the valve or base body)

is still moving towards the connecting union C, while pre-injection is already completed. The length ($L_v$) of the time-delay circuit 5 corresponds to the equation $L_v \leqq cT$, where c is the sound velocity in the Diesel fuel, and T is the shortest ignition leg that could be expected in the performance range of the engine. In order that the level of the wave front pressure during the period of the pre-injection phase does not drop too much, the ratio of the feed line diameter $d_s$ (=bore diameter of circuit 4 and connecting union A, including the shorter circuit 6) to the time-delay circuit bore diameter $d_v$ (=bore of circuit 5 or, respectively, connecting unions B and C) is between 1 and 2.

In order to prevent the flow of fuel to the connecting union D from being disturbed, the bore diameters of the radial ports 11 are at least equal to the bore diameter of the time-delay circuit 5.

Immediately after arrival of the delayed pressure wave at the check valve 8, movement of the check valve piston 8*a* in the opening sense is initiated. As a result, the fuel passes into the space 10 as well as into the shank region $7a_2$ of the metering piston 7*a*. From there, the fuel follows the same route to the connecting union D as did just previously the pre-injection quantity, but this time in order to inject the main injection quantity. The process of main injection ensures that the pressure space 10 is vented.

Simultaneous with the movement of the piston 8*a* of the check valve 8, an increase is effected in the pre-loading of the spring 7*b* (8*b*), which in turn initiates movement of the metering piston 7*a* into its initial position. It is obvious that this spring should be as weak as possible. The slight acceleration of the metering piston resulting in the direction of the initial position ensures that the main injection is not reduced by any appreciable volume fractions.

When the decreasing flank of the line pressure arrives at the check valve 8, main injection is completed. The process of terminating the main injection is prepared briefly beforehand by the increase of the force acting on the metering piston 7*a* to move it in the direction towards the initial position (the cause is in the increase in the differential pressure across the metering piston with the opposite or inverse sign). The movement of the piston 7*a* which then starts instantly is desirable for two reasons: firstly, the weak force of the pre-loading spring 7*b* (8*b*) alone would not be sufficient to reliably restore the piston 7*a* into the initial position during the short working cycle (especially in the range of high engine speeds). Secondly, the fast movement of the displacement piston 7*a* is accompanied by a volume removal from the pressure space 10, the consequence of which is an accelerated pressure reduction at the same location.

This again has a positive effect on the closing of the nozzle needle inasmuch as the latter will drop at a higher speed onto its seat (thereby reducing carbon deposits in the nozzle; also, hydrocarbon components in the exhaust gas are reduced).

Pressure reduction is additionally assisted by the relief or balancing piston 8*a* of the check valve 8. This piston comes into action when the end of the pressure wave leaves the outlet of the time-delay circuit and, consequently, no fuel volume has to be delivered over the seat faces 8*c* of the check valve 8 (which would prevent the latter from closing). As a result, the piston 8*a*, under the influence of the line pressure remaining in the pressure space 10 and the pre-loading of the spring 8*b* (7*b*), is forced into its position against the stop.

The present invention is, of course, in no way restricted to the specific disclosure of the specification and drawings, but also encompasses any modifications within the scope of the appended claims.

What I claim is:

1. In a fuel injection system combined into one unit, for self-ignition internal combustion engines operative with speed and load of such engine respectively, that includes an injection pump which delivers metered fuel quantities with a level and a time pattern of pump pressure, at periodic intervals, via a connecting line to an injection means including a main injection feed line having an outlet end, with at least part of said connecting line comprising two different-length circuits which are connected in parallel and which cause the fuel quantity supplied to the feed line to be divided such that, on the one hand, a small fuel quantity in a first pre-injection phase (pre-injection quantity) passes through the shorter circuit to said injection means and, on the other hand, a larger fuel quantity in a second main injection phase (time-delay circuit), with the two fuel quantities of the first and second phases respectively reaching said injection means with an exact time lag relative to one another, the improvement therewith comprising:

a metering valve unit disposed in said shorter circuit to permit a quantity of fuel for the pre-injection phase to be metered which remains constant at all times subject to point of commencement of the pre-injection phase being accurately set practically independent of the level and the time pattern of the pump pressure and being practically independent of speed and load of the engine; and a check valve unit disposed in said longer time-delay circuit at that end thereof closest to said injection means, with the ratio of the diameter of said feed line, including said shorter circuit, to the diameter of said time-delay circuit being in a range of between 1 and 2, said check valve unit ensuring satisfactory hydraulic uncoupling of the two fuel injection phases (pre-injection and main injection quantities) effected at the same time intervals at all times, said check valve unit also preventing pressure and volume waves of the first pre-injection phase from entering the outlet end of the main injection feed line and as a result no volume losses of the pre-injection quantity and metering inaccuracies liable to be produced therewith will occur nor are there any multiple reflections of pressure waves alternately entering into either line and any resultant interference with pre-injection and main injection phases can be successfully avoided.

2. A fuel injection system according to claim 1, in which said shorter circuit is of as short a length as possible, with said metering valve unit being disposed in the immediate vicinity of said injection means.

3. A fuel injection system according to claim 2, in which said metering valve unit comprises: a specially shaped pre-injection piston that is subjected to the pressure of supplied fuel and is provided with return spring means that urge said pre-injection piston in a direction counter to said fuel pressure, and stop means for limiting the travel of said pre-injection piston.

4. A fuel injection system according to claim 3, in which said check valve unit also comprises: a specially shaped piston that is subjected to the pressure of supplied fuel and is provided with return spring means that urge said piston in a direction counter to said fuel pressure, and stop means for limiting the travel of said piston.

5. In a fuel injection system, for self-ignition internal combustion engines, that includes an injection pump which delivers metered fuel quantities, at periodic intervals, via a connecting line to an injection means, with at least part of said connecting line comprising two different-length circuits which are connected in parallel and which cause the fuel quantity supplied via a feed line to be divided in such a manner that, on the one hand, a small fuel quantity (pre-injection quantity) passes through the shorter circuit and, on the other hand, a larger fuel quantity (main injection quantity) passes through the longer circuit (time-delay circuit), with the two fuel quantities reaching said injection means with a time lag relative to one another, the improvement comprising:

a metering valve unit disposed in said shorter circuit;

a check valve unit disposed in said longer time-delay circuit at that end thereof closest to said injection means, with the ratio of the diameter of said feed line, including said shorter circuit, to the diameter of said time-delay circuit being between 1 and 2; said shorter circuit being of as short a length as possible, with said metering valve unit being disposed in the immediate vicinity of said injection means; said metering valve unit comprising: a specially shaped pre-injection piston that is subjected to the pressure of supplied fuel and is provided with return spring means that urge said pre-injection piston in a direction counter to said fuel pressure, and stop means for limiting the travel of said pre-injection piston; said check valve unit also comprising: a specially shaped piston that is subjected to the pressure of supplied fuel and is provided with return spring means that urge said piston in a direction counter to said fuel pressure, and stop means for limiting the travel of said piston;

said metering valve unit and said check valve unit being sequentially arranged in a single integral component having appropriate connection unions, with said spring means of both units being a single pre-loading spring.

6. A fuel injection system according to claim 5, which includes housing means for said pre-injection piston of said metering valve unit and for said piston of said check valve unit, with each of said pistons having several different cross-sectional areas along the longitudinal direction thereof, whereby the largest cross-sectional area forms part of said stop means, and the remainder of said piston is divided into a central portion and the piston shank, with said central portion and said piston shank being guided in said housing means.

7. A fuel injection system according to claim 6, in which said pre-injection piston of said metering valve unit is provided with at least one chamfer at the end of said central portion thereof in the direction towards the transition from said central portion to said piston shank.

8. A fuel injection system according to claim 7, in which each of said piston shanks of said pistons of said metering valve unit and said check valve unit has a cross-shaped cross section formed by axis-parallel recesses that leave cross beams, with the latter, at the transition to the central portion of said piston, being slightly turned down in the circumferential direction to form cutouts.

9. A fuel injection system according to claim 8, in which said housing means for said piston of said metering valve unit is provided with radial ports that are angularly offset or staggered relative to one another, and communicate with periheral grooves and axial connecting grooves.

10. A fuel injection system according to claim 9, in which said integral component includes a base body, with a liner being disposed between said housing means for said piston of said metering valve unit, and said base body, with said liner being provided with radial ports that communicate with said connecting grooves, and with a circumferential groove and radial port in said base body, with said radial port in turn opening into a connection union for said injection means.

11. A fuel injection system according to claim 10, in which, in conformity with a pressure wave cycle, the length $L_v$ of said time-delay circuit is at most equal to the shortest ignition lag that arises in the performance range of the engine, so that $L_v \leqq cT$, where c is the velocity of sound in the Diesel fuel, and T is the shortest operationally arising ignition lag.

* * * * *